US010300712B2

(12) United States Patent
Sakamoto et al.

(10) Patent No.: US 10,300,712 B2
(45) Date of Patent: May 28, 2019

(54) DRYING DEVICE AND PRINTING APPARATUS

(71) Applicants: Wataru Sakamoto, Tokyo (JP); Ken Onodera, Kanagawa (JP); Toshihiro Yoshinuma, Kanagawa (JP)

(72) Inventors: Wataru Sakamoto, Tokyo (JP); Ken Onodera, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 8 days.

(21) Appl. No.: 15/641,634

(22) Filed: Jul. 5, 2017

(65) Prior Publication Data

US 2018/0009237 A1 Jan. 11, 2018

(30) Foreign Application Priority Data

Jul. 8, 2016 (JP) ..... 2016-135706
Apr. 27, 2017 (JP) ..... 2017-088515

(51) Int. Cl.
*B41J 11/00* (2006.01)
*B41J 2/045* (2006.01)

(52) U.S. Cl.
CPC ..... *B41J 11/002* (2013.01); *B41J 2/0454* (2013.01)

(58) Field of Classification Search
CPC .... B41J 11/002; B41J 2/0454; B41J 2/04553; D06F 75/26
See application file for complete search history.

(56) References Cited

U.S. PATENT DOCUMENTS

| | | | | |
|---|---|---|---|---|
| 9,605,900 | B2 * | 3/2017 | Boland | F26B 13/14 |
| 2014/0232797 | A1 | 8/2014 | Onodera et al. | |
| 2014/0270824 | A1 * | 9/2014 | Satoh | G03G 15/2042 399/45 |
| 2015/0174921 | A1 | 6/2015 | Onodera et al. | |
| 2016/0273832 | A1 * | 9/2016 | Asada | B41J 11/002 |
| 2017/0120625 | A1 | 5/2017 | Yoshinuma | |

FOREIGN PATENT DOCUMENTS

| | | |
|---|---|---|
| JP | 5-008372 | 1/1993 |
| JP | 2014-136315 | 7/2014 |
| JP | 2015-178261 | 10/2015 |
| JP | 2016-016598 | 2/2016 |

* cited by examiner

*Primary Examiner* — Henok D Legesse
(74) *Attorney, Agent, or Firm* — Oblon, McClelland, Maier & Neustadt, L.L.P.

(57) ABSTRACT

A drying device includes a heater, a supporter, a controller, and a temperature detector. The heater heats a medium. The supporter is disposed opposite the heater to support the medium. The controller turns on the heater while the medium is conveyed, and turns off the heater when the medium is stopped. The temperature detector detects a temperature of the supporter. The controller is connected to the temperature detector to turn off the heater when the temperature detected with the temperature detector is a predetermined temperature or higher.

12 Claims, 8 Drawing Sheets

DRYING DEVICE AND PRINTING APPARATUS

CROSS-REFERENCE TO RELATED APPLICATIONS

This patent application is based on and claims priority pursuant to 35 U.S.C. § 119(a) to Japanese Patent Application Nos. 2016-135706, filed on Jul. 8, 2016, and 2017-088515, filed on Apr. 27, 2017 in the Japan Patent Office, the entire disclosure of each of which is hereby incorporated by reference herein.

BACKGROUND

Technical Field

Embodiments of the present disclosure relate to a drying device and a printing apparatus.

Related Art

As a printing apparatus to apply liquid to a continuous sheet or the like to perform printing, for example, an apparatus is known that applies liquid to a continuous sheet or the like and then dries the liquid with a heater.

SUMMARY

In an aspect of the present disclosure, there is provided a drying device that includes a heater, a supporter, a controller, and a temperature detector. The heater heats a medium. The supporter is disposed opposite the heater to support the medium. The controller turns on the heater while the medium is conveyed, and turns off the heater when the medium is stopped. The temperature detector detects a temperature of the supporter. The controller is connected to the temperature detector to turn off the heater when the temperature detected with the temperature detector is a predetermined temperature or higher.

In another aspect of the present disclosure, there is provided a drying device that includes a heater, a supporter, a controller, and a cut-off switch. The heater heats a medium. The supporter is disposed opposite the heater to support the medium. The controller turns on the heater while the medium is conveyed, and turns off the heater when the medium is stopped. The cut-off switch is connected to the controller to cut off power supply to the heater when a temperature of the supporter is a predetermined temperature or higher.

In still another aspect of the present disclosure, there is provided a printing apparatus that includes a liquid applicator and the drying device according to any of the above-described aspects. The liquid applicator applies liquid onto the medium. The drying device dries the medium applied with the liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
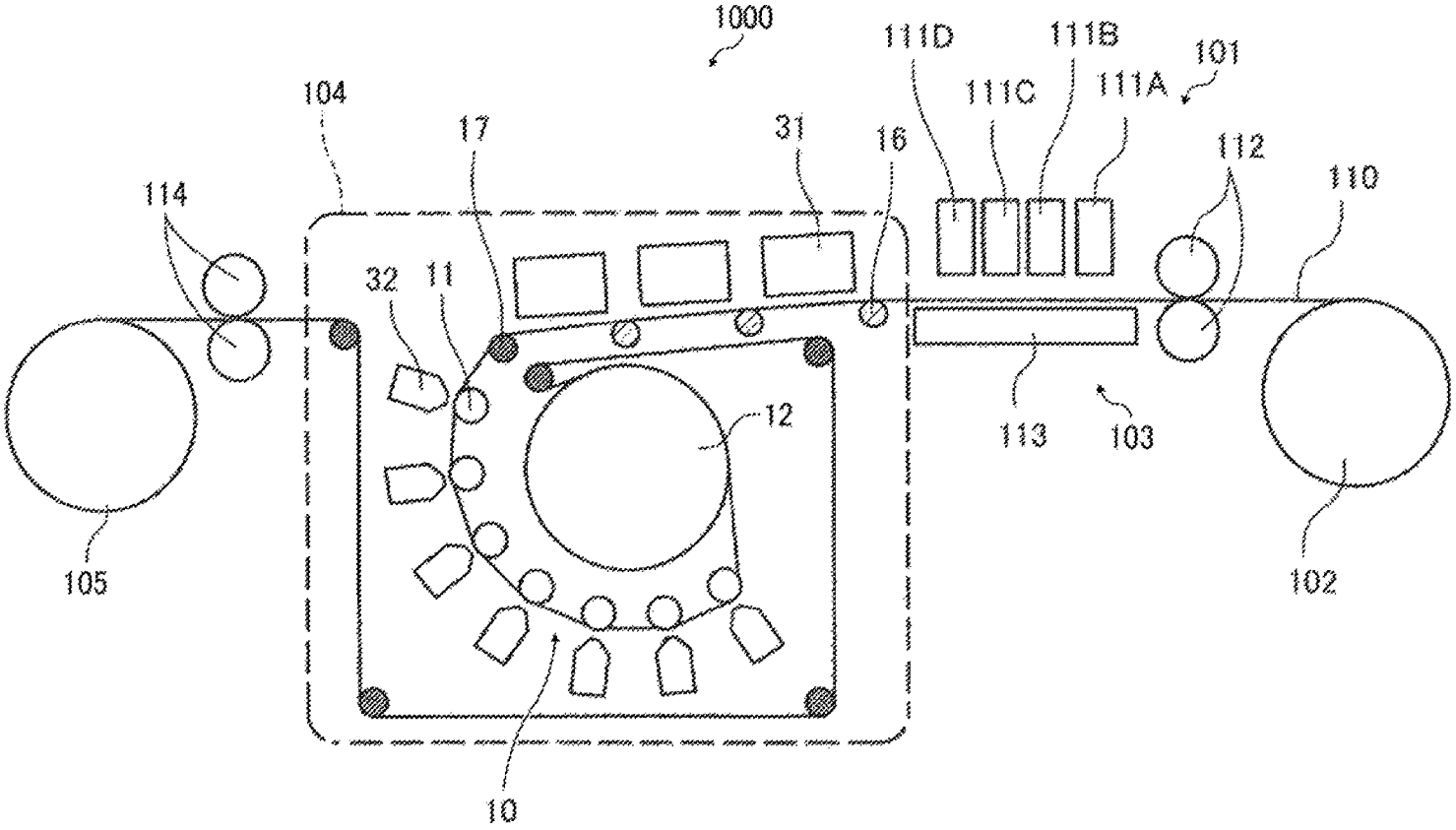
FIG. 1 is a schematic view of a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

As used herein, the singular forms "a", "an", and "the" are intended to include the plural forms as well, unless the context clearly indicates otherwise.

Although the embodiments are described with technical limitations with reference to the attached drawings, such description is not intended to limit the scope of the disclosure and all of the components or elements described in the embodiments of this disclosure are not necessarily indispensable.

Referring now to the drawings, wherein like reference numerals designate identical or corresponding parts throughout the several views, embodiments of the present disclosure are described below. First, a printing apparatus according to a first embodiment of the present disclosure is described with reference to FIG. 1. FIG. 1 is a schematic view of the printing apparatus according to the first embodiment.

The printing apparatus 1000 illustrated in FIG. 1 is an inkjet recording apparatus, and includes a liquid application unit 101 including a liquid discharge head, which is a liquid applicator, to discharge and apply ink, which is a color liquid, onto a continuous sheet 110, which is a conveyed material (hereinafter, referred to as "medium").

In the liquid application unit 101, for example, full-line heads 111A, 111B, 111C, and 111D (referred to as "heads 111" unless colors distinguished) of four colors are disposed in this order from the upstream side in a conveyance direction of the continuous sheet 110. The heads 111 apply liquids of black (K), cyan (C), magenta (M), and yellow (Y) onto the continuous sheet 110. Note that the number and types of color are not limited to the above-described four colors of K, C, M, and Y and may be any other suitable number and types.

The continuous sheet 110 is fed from a feeding roller 102, is sent onto a conveyance guide 113 by conveyance rollers 112 of a conveyance unit 103, and is guided and conveyed (moved) by the conveyance guide 113. The conveyance guide 113 is disposed to face die liquid application unit 101.

The continuous sheet 110, onto which the liquid is applied by the liquid application unit 101, is sent by ejection rollers 114 through a drying device 104 as a drying device according to the present embodiment, and is wound around a winding roller 105.

Figure 2:
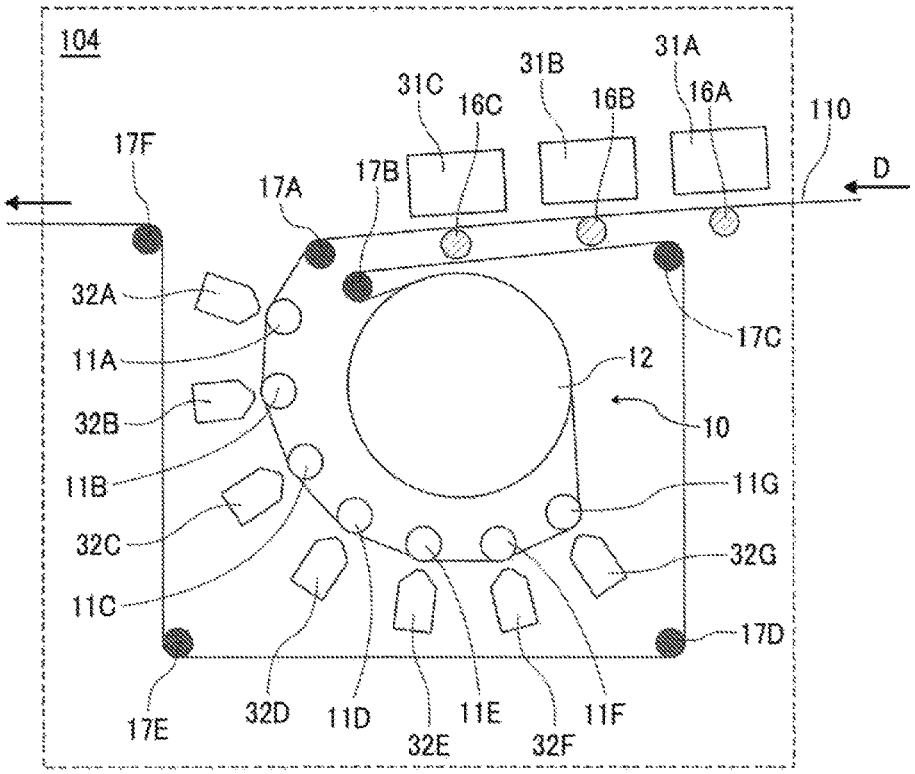
FIG. 2 is an enlarged view of a drying device according to the first embodiment.

Next, the drying device according to the first embodiment is further described with reference to FIG. 2. FIG. 2 is an enlarged view of the drying device.

The drying device 104 includes the contact heater 10 to heat the continuous sheet 110 in contact with a surface of the continuous sheet 110 on a side opposite to a surface onto which the liquid is applied.

The drying device 104 includes a guide roller 17A to guide the continuous sheet 110, which is sent from the conveyance unit 103, to the contact heater 10, and guide rollers 17B to 17F to guide the continuous sheet 110 that passes through the contact heater 10. The guide rollers 17A to 17F may be collectively referred to as the guide roller 17 unless distinguished.

The contact heater 10 includes a plurality of first heating rollers 11A to 11G, which are first contact heating members, each having a curved contact face 11*a* to contact the continuous sheet 110, and a heating drum 12, which is a second contact heating member, having a curved contact face 12*a* to also contact the continuous sheet 110. The first heating rollers 11A to 11G may have different diameters. In the present embodiment, all of the first heating rollers 11A to 11G and the heating drum 12 are rollers.

The plurality of fast heating rollers 11A to 11G (hereinafter, referred to as first "heating roller(s) 11" unless distinguished, which is also applied to other members) are disposed in an arcuate (or circular arc) arrangement along the conveyance direction of the continuous sheet 110 around the heating drum 12.

Here, the heating drum 12 is a contact heating member having a maximum contact distance, among contact heating members to contact the surface of the continuous sheet 110 on a side opposite to a liquid applied surface of the continuous sheet 110. Here the heating rollers 11A to 11G are contact heating members upstream from the heating drum 12 in the conveyance direction, among the contact heating members to contact the surface of the continuous sheet 110 on the side opposite to the liquid applied surface of the continuous sheet 110.

Figure 3A:
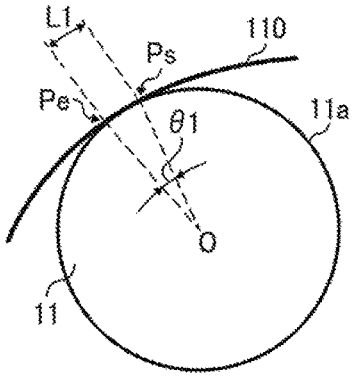
FIG. 3A is an illustration of a winding angle of a continuous sheet relative to a heating roller of the drying device.
Figure 3B:
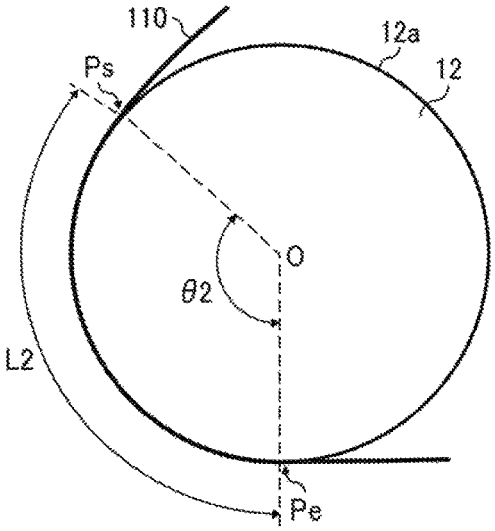
FIG. 3B is an illustration of a winding angle of a continuous sheet relative to a heating drum of the drying device.

As illustrated in FIGS. 3A and 3B, a conveyance path is configured such that a contact distance L2 between the contact face 12*a* of the heating drum 12 and the continuous sheet 110 is longer than a contact distance L1 between the contact face 11*a* of each of the heating rollers 11A to 11G and the continuous sheet 110. The "contact distance" is a distance at which the continuous sheet 110 contacts a circumferential surface of the heating drum 12 and the heating rollers 11 in a direction along a circumferential direction of the heating drum 12 and the heating roller 11 (the conveyance direction). When the contact heating member is a curved member having a curved surface as a contact face, the contact distance is a distance at which the continuous sheet 110 is in contact with the curved surface in the direction (conveyance direction) along the circumferential direction of the curved surface.

Here, a winding angle θ2 of the continuous sheet 110 with respect to the contact face 12*a* of the heating drum 12 is greater than a winding angle θ1 of the continuous sheet 110 with respect to the contact face 11*a* of the heating roller 11 (θ2>θ1).

As illustrated in FIGS. 3A and 3B, the winding angles θ2 and θ1 (collectively referred to as "winding angle θ") indicate angles of a point Ps at which the contact of the continuous sheet 110 with the contact faces 12*a* and 11*a* starts and a point Pe at which the contact of the continuous sheet 110 with the contact faces 12*a* and 11*a* ends, with respect to a center O.

Therefore, in a case where the winding angle θ increases, the contact distance also increases insofar as rotary bodies have the same diameter, and even in a case where the winding angles θ are identical to each other, the contact distance increases as the diameter of the rotary body increases.

In the present embodiment, the diameter of the heating drum 12 is greater than the diameter of the heating roller 11, and the winding angle θ2 is greater than the winding angle θ1, and thus, in any case, the contact distance L2 between the contact face 12*a* of the heating drum 12 and the continuous sheet 110 is longer than the contact distance L1 between the contact face 11*a* of the heating roller 11 and the continuous sheet 110.

As described above, even in a case where the winding angles θ are identical to each other, the contact distance increases as the diameter of the rotary body increases. Therefore, by setting the heating drum 12 and the heating roller 11 to have the same diameter, and the winding angle θ2 to be greater than the winding angle θ1, the contact distance L2 between the contact face 12*a* of the heating drum 12 and the continuous sheet 110 is longer than the contact distance L1 between the contact face 11*a* of the heating roller 11 and the continuous sheet 110.

Such a configuration can reduce cockling and improve drying efficiency.

For example, in a state where a time does not elapse from the liquid application, the strength of the continuous sheet 110 decreases. Accordingly, it may be difficult to bring the continuous sheet 110 on a rear surface side closely into contact with a circumferential surface (a contact face) of the rotary body in a wide range (a long contact distance).

Hence, in an initial state where the applied liquid is not dried, the winding angle θ of the continuous sheet 110 with respect to the heating roller 11 decreases, and thus, the contact distance is shortened.

Here, by increasing the curvature of the heating roller 11, a tensile force generated at the time of conveying the continuous sheet 110 is changed to a pressing force in a contact portion with the heating roller 11, and thus, a contact state with respect to the heating roller 11 becomes even. In such a state, cockling or wrinkles do not occur on the continuous sheet 110, and when the continuous sheet 110 passes through the heating roller 11, heat required for evenly drying the liquid on the continuous sheet 110 can be supplied.

Accordingly, the continuous sheet 110, in which the cockling is reduced and the drying is performed, can closely contact the contact face even in a case where the contact distance with respect to the rotary body increases.

The inventors measured the height of cockling and the pitch of cockling occurring in the continuous sheet 110, and checked the presence or absence of visually observable cockling, by changing the diameter of the heating roller 11. In this example, the cockling height was almost halved compared with a case where the diameter of the heating roller 11 was 250 mm, by setting the diameter of the heating roller 11 to 200 mm. The cockling disappeared by setting the diameter of the heating roller 11 to be 100 mm or less.

Therefore, the diameter of the heating roller 11 is preferably 200 mm or less, more preferably 100 mm or less.

The heating drum 12 disposed downstream from the heating roller 11 increases the contact distance with respect to the continuous sheet 110. Such a configuration allows heat to be supplied to the continuous sheet 110 for a short period of time, thus improving the drying efficiency to perform the drying for a short period of time.

Note that, in some embodiments, an increased number of heating rollers 11 to contact the continuous sheet 110 may be employed to increase the drying heat quantity. Such a configuration can increase the drying rate even in a case of a thick continuous body, thus ensuring high productivity.

In the present embodiment, at least one of the guide rollers 17A to 17F may be a heating roller (a heating member).

The infrared heaters 31A to 31C as heaters to heat the continuous sheet 110 fed into the drying device 104 are disposed at an entry portion of the drying device 104. Idler rollers 16A to 16C as supporters to support the continuous sheet 110 are disposed opposite the infrared heaters 31A to 31C. The idler rollers 16A to 16C rotate with movement of the continuous sheet 110.

Warm-air fans 32A to 32G to blow warm air to the continuous sheet 110 are disposed opposite the first heating rollers 11.

Figure 4:
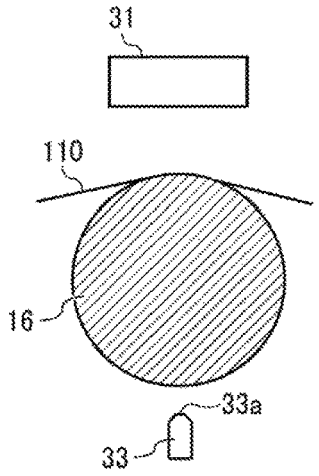
FIG. 4 is a side view of an area around one infrared heater seen from a roller axial direction to illustrate a first example of temperature detection.
Figure 5:
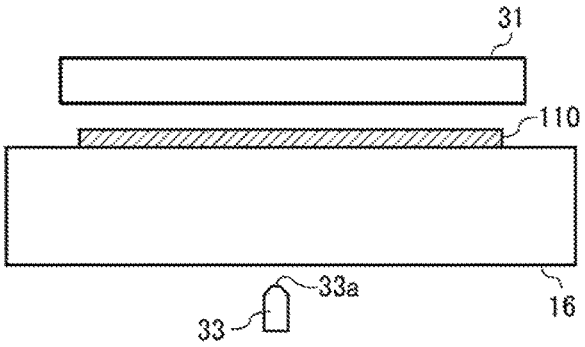
FIG. 5 is an illustration of the area of FIG. 4 seen from a roller longitudinal direction.

Next, a first example of temperature detection is described with reference to FIGS. 4 and 5. FIG. 4 is a side view of an area around one infrared heater seen from a roller axial direction. FIG. 5 is an illustration of the area seen from a roller longitudinal direction.

The longitudinal length of the infrared heater 31 is slightly longer than the width of the continuous sheet 110 (the width of the medium).

The idler roller 16 is disposed opposite the infrared heater 31. The temperature sensor 33 is disposed as a temperature detector to detect the temperature of the idler roller 16. The temperature sensor 33 may be any of a contact-type sensor and a non-contact sensor.

The temperature sensor 33 is disposed directly below the idler roller 16. In such a case, in the roller longitudinal direction, the temperature sensor 33 is preferably disposed near a central position in the roller longitudinal direction.

Here, a reason for detecting the temperature of the idler roller 16 without directly detecting the temperature of the medium (the continuous sheet 110) is as follow. That is, since different types (sheet types) of media have different characteristic values, the standard of determination of abnormal temperature would be complicated if the temperature of the medium is directly detected. Hence, in this example, the heater is disposed opposite the heater to indirectly detect the temperature of the idler roller 16, thus simplifying the standard of determination of abnormal temperature.

In this example, one reason that the temperature sensor 33 is disposed at an opposite side of the infrared heater 31 via the idler roller 16 is as follow.

The temperature sensor 33 can be disposed at a lateral side of the idler roller 16. However, in such a configuration, the temperature sensor 33 is likely to receive direct heat energy (radiation heat) from the infrared heater 31. The temperature of the idler roller 16 might be accurately detected.

Therefore, the temperature sensor 33 is preferably disposed at a position away from the infrared heater 31. In this example, with respect to the idler rollers 16, the temperature sensor 33 is disposed at a side opposite a side at which the infrared heater 31 is disposed.

When the temperature sensor 33 is an infrared sensor, the arrangement of the temperature sensor 33 at the opposite side of the infrared heater 31 via the idler roller 16 can reduce the interference between infrared rays emitted from the infrared sensor and infrared rays emitted from the infrared heater 31.

In the present embodiment, the idler roller 16 is disposed at a position higher than the heating drum 12. In such a case, if the temperature sensor 33 is disposed near the idler roller 16, steam generated from the heating drum 12 might rise and attach a lens surface 33*a* as a detecting portion of the temperature sensor 33. Hence, to detect the temperature of the idler roller 16 at a position higher than the heating drum 12, the lens surface of the temperature sensor 33 is preferably directed to the opposite side of the heating drum 12.

Figure 6:
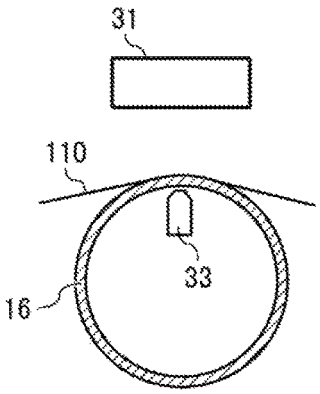
FIG. 6 is a side view of an area around one infrared heater seen from a roller axial direction to illustrate a second example of temperature detection.
Figure 7:
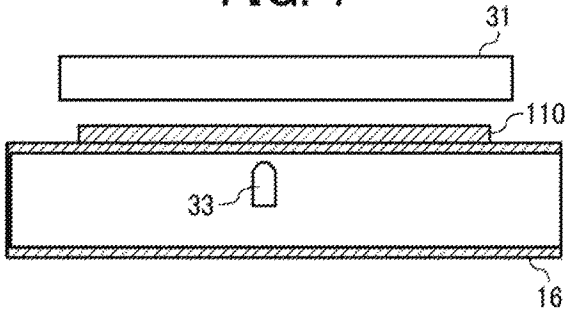
FIG. 7 is an illustration of the area around the infrared heater of FIG. 6 seen from a roller longitudinal direction.

Next, a second example of temperature detection is described with reference to FIGS. 6 and 7. FIG. 6 is a side view of an area around one infrared heater seen from the roller axial direction. FIG. 7 is a cross-sectional view of the area seen from the roller longitudinal direction.

The longitudinal length of the infrared heater 31 is slightly longer than the width of the continuous sheet 110 (the width of the medium).

The idler roller 16 is disposed opposite the infrared heater 31. Here, the idler roller 16 is a hollow roller (sleeve roller). The temperature sensor 33 as a temperature detector to detect the temperature of the idler roller 16 is disposed inside the idler roller 16.

The temperature sensor 33 is preferably disposed at an inner side of a contact portion of the idler roller 16 at which the idler roller 16 contacts the continuous sheet 110.

According to the second example, the temperature of a portion (a most heated portion) that receives a largest amount of heat from the infrared heater 31 can be promptly detected. In other words, the most heated portion receiving the largest amount of heat from the infrared heater 31 is a surface of the idler roller 16 facing the infrared heater 31. However, since the continuous sheet 110 passes the side of the infrared heater 31, the temperature of the most heated portion cannot directly detected. Hence, in the present embodiment, the idler roller 16 has a hollow structure and an inner surface of the idler roller 16 at the side of the infrared heater 31 is set to a detection surface, thus allowing detection of the temperature of the most heated portion of the idler roller 16.

Figure 8:
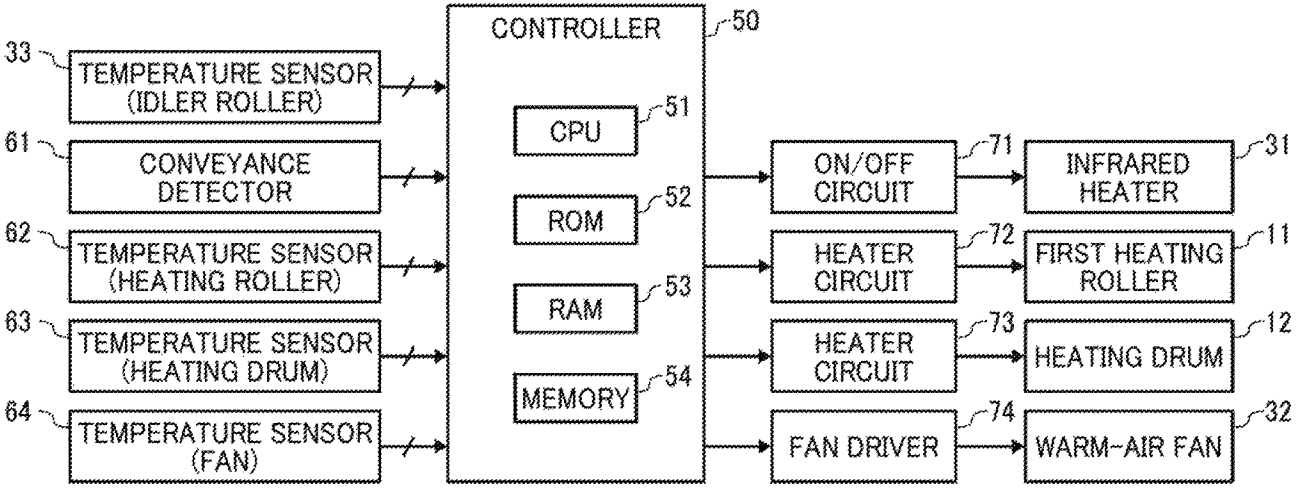
FIG. 8 is a block diagram of a drying controller according to an embodiment of the present disclosure.

Next, a drying controller is described with reference to FIG. 8. FIG. 8 is a block diagram of the drying controller according to an embodiment present disclosure.

A controller 50 as the drying controller includes, for example, a central processing unit (CPU) 51, a read only memory (ROM) 52, a random access memory (RAM) 53, an input-and-output unit (I/O), and a memory 54 (the ROM 52 may also act as the memory 54). The controller 50 also serves as a controller according to an embodiment of the present disclosure to control the entire drying device 104. Note that the controller 50 may be part of a controller of the entire printing apparatus 1000.

The controller 50 receives conveyance detection signals from a conveyance detector 61 that detects conveyance and conveyance stop of the continuous sheet 110 and detection signals of a temperature sensor 62, a temperature sensor 63, and a temperature sensor 64. The temperature sensor 62 detects the temperature of the first heating roller 11. The temperature sensor 63 detects the temperature of the heating drum 12. The temperature sensor 64 detects the temperature of the warm-air fan 32.

For example, the conveyance detector 61 detects tension of the continuous sheet 110, and detects the conveyance stop when the tension is not detected. Alternatively, in some embodiments, the conveyance detector 61 may detect the presence or absence of the continuous sheet 110 at a predetermined position on the conveyance path of the continuous sheet 110. In such a case, when the continuous sheet 110 is absence at the predetermined position, the conveyance detector 61 detects the conveyance stop.

Receiving the conveyance detection signal from the conveyance detector 61, the controller 50 controls an ON/OFF circuit 71 to turn on the infrared heater 31 as the heater while the continuous sheet 110 is conveyed, and turn off the infrared heater 31 when the continuous sheet 110 is stopped. Accordingly, while the continuous sheet 110 is conveyed, the continuous sheet 110 is continuously heated by the infrared heater 31. However, a heated portion of the continuous sheet 110 constantly changes with movement of the continuous sheet 110, thus preventing abnormal heating.

Note that the detection of start and stop of conveyance of the continuous sheet 110 can be determined according to an instruction signal from the controller that generally controls the printing apparatus 1000.

The controller 50 detects the roller temperature from a detection signal of the temperature sensor 62, and controls the power supply to a heating source (heater) of the first heating rollers 11 via a heater circuit 72. Thus, the controller 50 controls the heating temperature of the first heating rollers 11 to be a desired temperature.

The controller 50 detects the drum temperature from a detection signal of the temperature sensor 63, and controls the power supply to a heating source (heater) of the heating drum 12 via a heater circuit 73. Thus, the controller 50 controls the heating temperature of the heating drum 12 to be a desired temperature.

The controller 50 detects the temperature of the warm-air fan 32 from a detection signal of the temperature sensor 64 and controls the heating temperature and the volume of air of the warm-air fan 32 via a fan driver 74.

The controller 50 receives a detection signal of the temperature sensor 33 that detects the temperature of the idler roller 16.

The controller 50 also acts as a controller of the infrared heater 31. The controller 50 turns off the infrared heater 31 via the ON/OFF circuit 71 when a detected temperature T0, which is a temperature of the idler roller 16 obtained from the detection signal of temperature sensor 33, is equal to or higher than a predetermined temperature Ta.

In the present embodiment, the controller 50 refers to a predetermined temperature Ta stored in the memory 54 and determines whether the detected temperature T0 is equal to or higher than the predetermined temperature Ta. For example, through preliminary experiments, the continuous sheet 110 may be continuously heated to examine a threshold temperature at which the color of the continuous sheet 110 changes and to set a temperature lower than the threshold temperature by a certain temperature to the predetermined temperature Ta.

Next, the control of the heater (infrared heater) performed by the drying controller is described with reference to a flowchart illustrated in FIG. 9.

For example, when the ON state of a heater continues regardless of the stop of a conveyed medium, the medium may be excessively heated, thus causing a change in color. Hence, it is conceivable to perform ON/OFF control to turn on the heater when the medium is conveyed, and turn off the heater when the medium is stopped.

However, for example, an erroneous conveyance detection might occur that erroneously detects that the medium is being conveyed even though the medium is actually stopped due to, e.g., a conveyance error. When only the ON/OFF control is used, the ON state of the heater would continue even in the occurrence of the erroneous conveyance detection, thus causing the above-described excessive heating.

Here, it is conceivable to directly detect the temperature of the medium and turn off the heater before the color of the medium changes.

However, as described above, since different types of media have different characteristic values, the standard of determination of abnormal temperature would be complicated when the temperature of the medium is directly detected.

Hence, according to an embodiment of the present disclosure, the control of the heater (infrared heater) by the drying controller is performed as follows.

Figure 9:
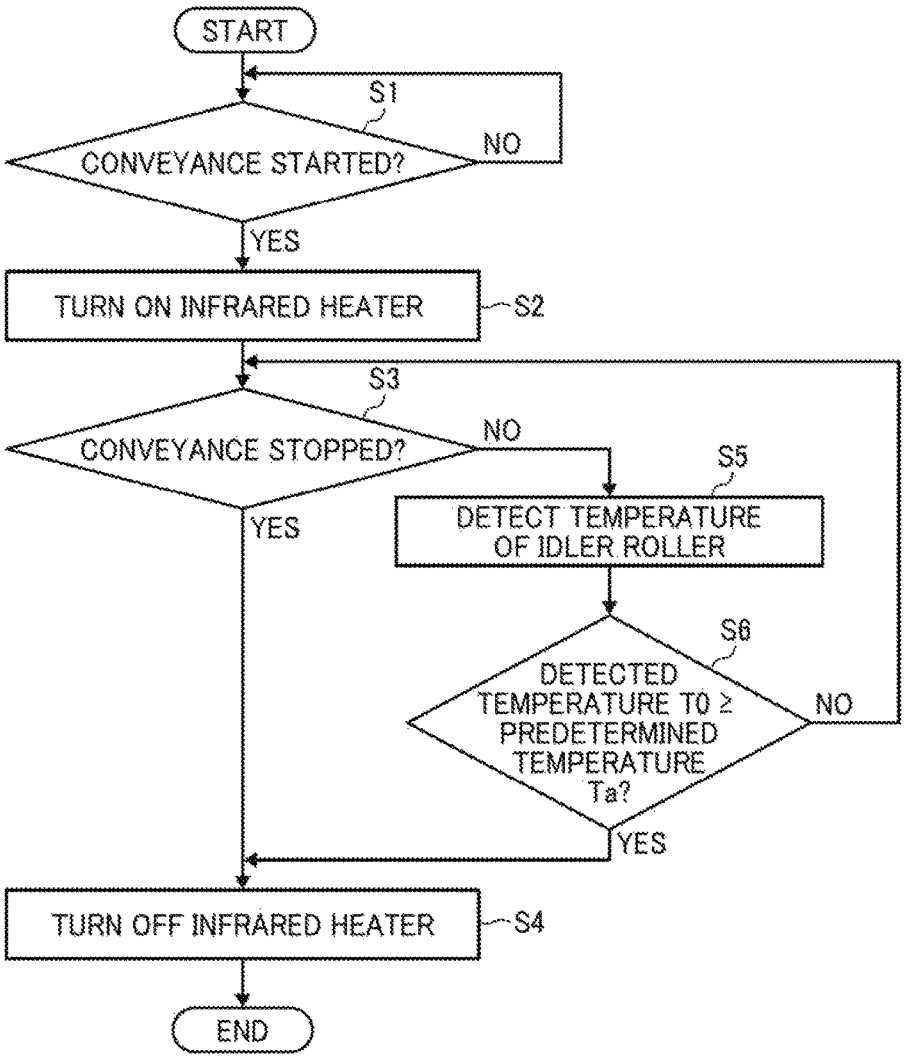
FIG. 9 is a flowchart of control of the heater performed by the drying controller.

As illustrated in FIG. 9, at S1, the controller 50 determines whether the conveyance of the continuous sheet 110 is started. When the conveyance of the continuous sheet 110 is started (YES at S1), the controller 50 turns on the infrared heater 31 (S2).

At S3, the controller 50 determines whether the conveyance of the continuous sheet 110 is stopped. When the conveyance of the continuous sheet 110 is stopped (YES at S3), the controller 50 turns off the infrared heater (S4).

By contrast, when the conveyance of the continuous sheet 110 is not stopped (NO at S3), the controller 50 reads the detection signal of the temperature sensor 33 and determines whether the detected temperature T0 of the idler roller 16 is equal to or higher than the predetermined temperature Ta (T0≥Ta).

Here, if the detected temperature T0 is lower than the predetermined temperature Ta (NO at S6), the controller 50 keeps the ON state of the infrared heater 31 and returns to S3 to determine whether the conveyance of the continuous sheet 110 is stopped.

By contrast, when the detected temperature T0 is equal to or higher than the predetermined temperature Ta, the controller 50 turns off the infrared heater 31 to stop heating.

In other words, when a detection error occurs in which the continuous sheet 110 is erroneously detected to be conveyed even though the continuous sheet 110 is actually stopped, the ON state of the infrared heater 31 continues and the same position of the continuous sheet 110 stopped is continuously heated.

Accordingly, the temperature of the idler roller 16 becomes higher than when the continuous sheet 110 is normally conveyed and heated with the infrared heater 31 while absorbing the heat of the infrared heater 31.

Hence, in the present embodiment, when the temperature of the idler roller 16 detected with the temperature sensor 33 is equal to or higher than the predetermined temperature, the controller 50 turns off the infrared heater 31 to stop heating.

Such a configuration can prevent abnormal heating that the same position the continuous sheet 110 stopped is continuously heated due to the erroneous conveyance detection.

Figure 10:
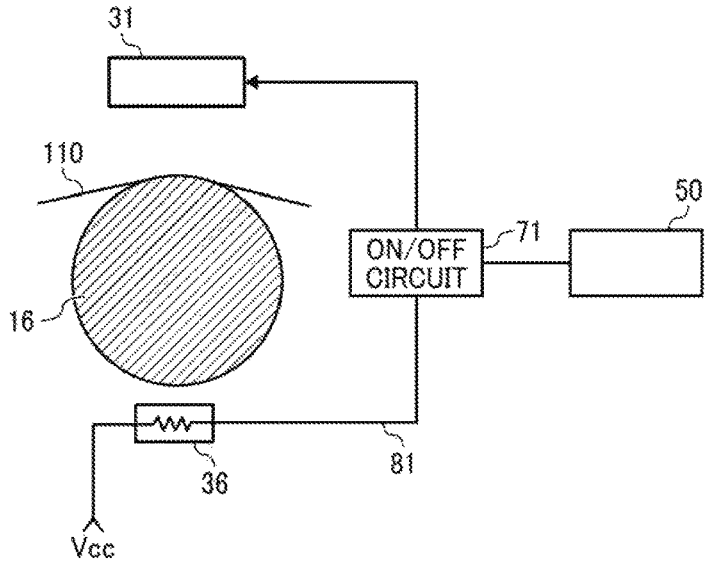
FIG. 10 is an illustration of a power feed line to the heater in the drying device according to the second embodiment.

Next, the drying device according to a second embodiment of the present disclosure is described with reference to FIG. 10. FIG. 10 is an illustration of a power feed line to the heater in the drying device according to the second embodiment.

In the present embodiment, a power feed line 81 of the infrared heater 31 includes a power cut-off unit 36 as a cut-off switch to cut off the power supply when the temperature of the idler roller 16 as the supporter is equal to or higher than the predetermined temperature Ta.

The power cut-off unit 36 is, for example, a thermostat and opens and closes an electrical contact point of the power feed line 81 with a contactor (an electromagnetic switch) of the thermostat, to start and stop the power supply to the infrared heater 31.

Alternatively, the power cut-off unit 36 may detect that the detection temperature of the temperature sensor 33 is equal to or higher than the predetermined temperature Ta, and open and close the electrical contact point of the power feed line 81 with the contactor to start and stop the power supply to the infrared heater 31.

With such a configuration, similarly with the fast embodiment when the temperature of the idler roller 16 is equal to or higher than the predetermined temperature Ta, the power feed line 81 to the infrared heater 31 is cut off to turn the infrared heater 31 off and stop heating.

Accordingly, such a configuration can prevent abnormal heating that the same position of the continuous sheet 110 stopped is continuously heated due to the erroneous conveyance detection.

Figure 11:
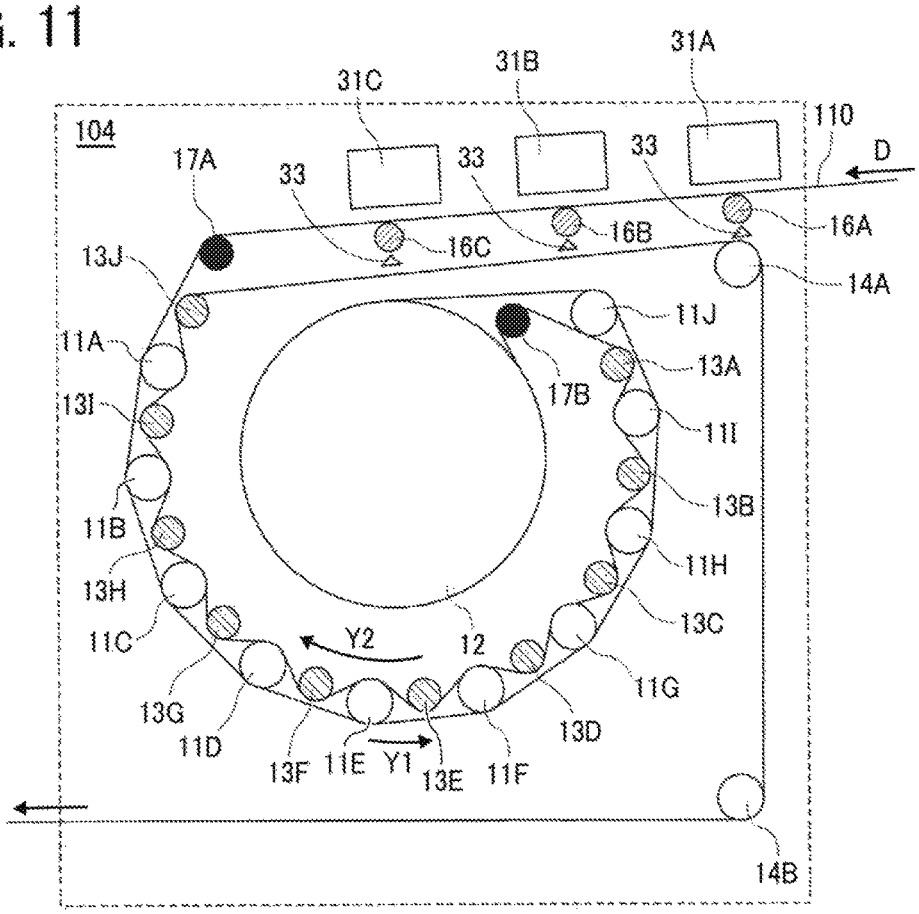
FIG. 11 is an enlarged view of the drying device according to a third embodiment of the present disclosure.

Next, a third embodiment according to the present disclosure is described with reference to FIG. 11. FIG. 11 is an enlarged view of a portion of the drying device according to the third embodiment.

In the present embodiment, the configuration of the printing apparatus 1000 is also identical to the configuration of the first embodiment except for the drying device 104.

The drying device 104 includes ten heating rollers 11 (11A to 11J) constituting the contact heater 10, the heating drum 12, and pressing rollers 13 (13A to 13J) to press the continuous sheet 110 against the heating rollers 11 (11A to 11J).

The drying device 104 includes the guide roller 17A to guide the continuous sheet 110 to the contact heater 10, and the guide roller 17B to wind the continuous sheet 110 around the heating drum 12. The drying device 104 includes heating rollers 14A and 14B that also function as guide rollers to guide the continuous sheet 110 from the contact heater 10.

Similarly, with the first embodiment, the infrared heaters 31A, 31B, and 31C, the idler rollers 16A, 16B, and 16C, and the temperature sensors 33 are disposed on the upstream side of the guide roller 17A in the conveyance direction (indicated by arrow D in FIG. 11) of the continuous sheet 110. The idler rollers 16A, 16B, and 16C are disposed opposite the infrared heaters 31A, 31B, and 31C. The temperature sensor 31 is a temperature detector to detect the temperature of the idler roller 16.

In the contact heater 10, the ten heating rollers 11 (11A to 11J) as a plurality of contact heating members are disposed around the heating drum 12 in a circular arc arrangement. Here, ten heating rollers 11 (11A to 11B) are disposed to surround the heating drum 12.

Note that, in the circumferential surface of the heating roller 11, a side closer to the heating drum 12 is referred to as an inner region and an opposite side of the heating drum 12 is referred to as an outer region. In this case, since the heating roller 11 rotates, circumferential surface portions which becomes the inner region and the outer region are sequentially changed.

Here, the continuous sheet 110 that is guided to the contact heater 10 by the guide roller 17A is conveyed in a direction (first direction) indicated by arrow Y1 in FIG. 11 while contacting a portion of the outer region of the circumferential surface of each of the heating rollers 11A to 11J, and reaches the circumferential surface of the heating drum 12. The continuous sheet 110 contacts approximately the entire circumference of the heating drum 12, and passes through the heating drum 12, and then, is guided again to the heating roller 11J by the guide roller 17B.

The continuous sheet 110 that is guided to the heating roller 11J is pressed against a portion of the inner region of the circumferential surface of the heating rollers 11J to 11A by the pressing rollers 13A to 13J, is conveyed in a direction (second direction) indicated by arrow Y2 in FIG. 2 different from the first direction, in a state where the continuous sheet 110 contacts again the heating rollers 11J to 11A, and is guided to a downstream side from the contact heater 10.

That is, a conveyance path on which the continuous sheet 110 is conveyed while contacting the plurality of heating rollers 11A to 11J includes a first path on which the continuous sheet 110 is conveyed in the first direction (the Y1 direction) while contacting the plurality of heating rollers 11A to 11J, and a second path on which the continuous sheet 110 is conveyed in the second direction (the Y2 direction) while contacting again the plurality of heating rollers 11J to 11A that contacts the continuous sheet 110 on the first path.

Accordingly, the number of heating rollers 11 increases and the drying rate increases while an increase in the size of the apparatus is reduced, and the continuous sheet 110 simultaneously contacts the contact face (the circumferential surface) of the heating roller 11 in different positions two times, thus further improving the drying rate.

Thus, the media to be conveyed are simultaneously in contact with different two portions of the same contact heating member (the same heating roller) and are heated.

Such a configuration can efficiently dry the medium to be conveyed by a relatively small number of contact heating members.

Figure 12:
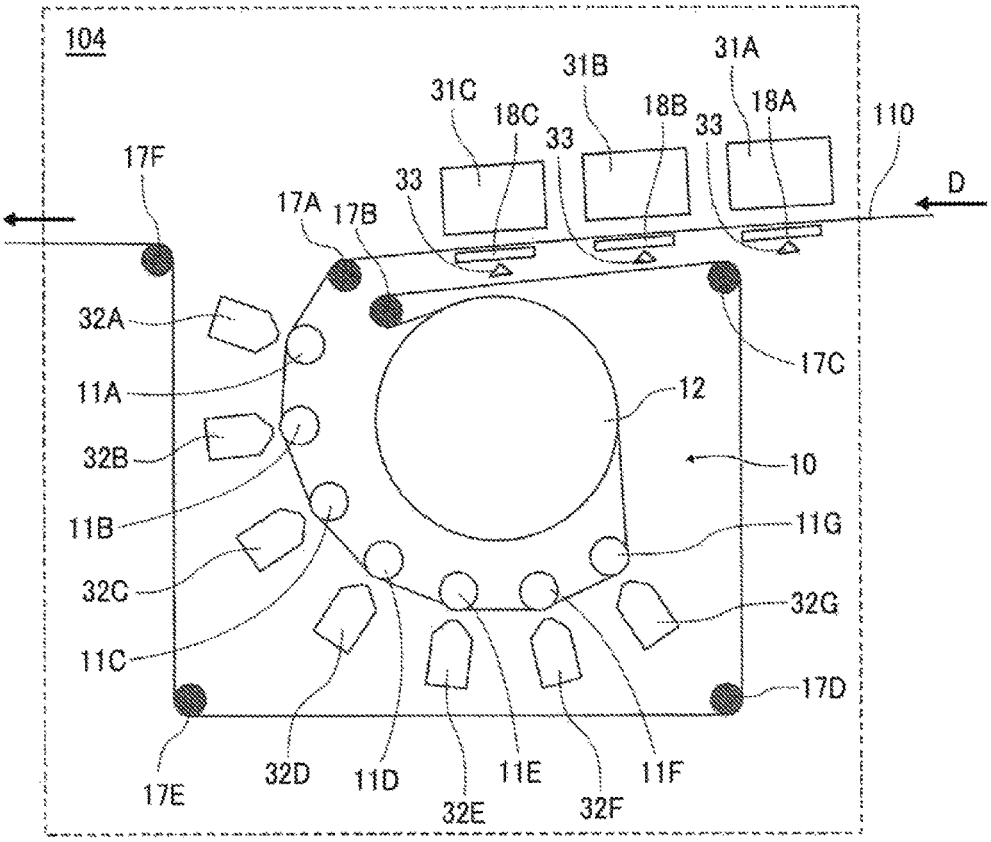
FIG. 12 is an enlarged view of the drying device according to a fourth embodiment of the present disclosure.

Next, a fourth embodiment according to the present disclosure is described with reference to FIG. 12. FIG. 12 is an enlarged view of a portion of the drying device according to the fourth embodiment.

In the present embodiment, guide plates 18A to 18C as supporters to support the continuous sheet 110 are disposed instead of the idler roller 16 in the above-described first embodiment.

Note that, in the above-described embodiments, the configuration is described in which a plurality of first contact heating members is arranged in series. However, in some embodiments, at least one simple roller (rotary body) other than the contact heating members may be disposed between the contact heating members.

Figure 13:
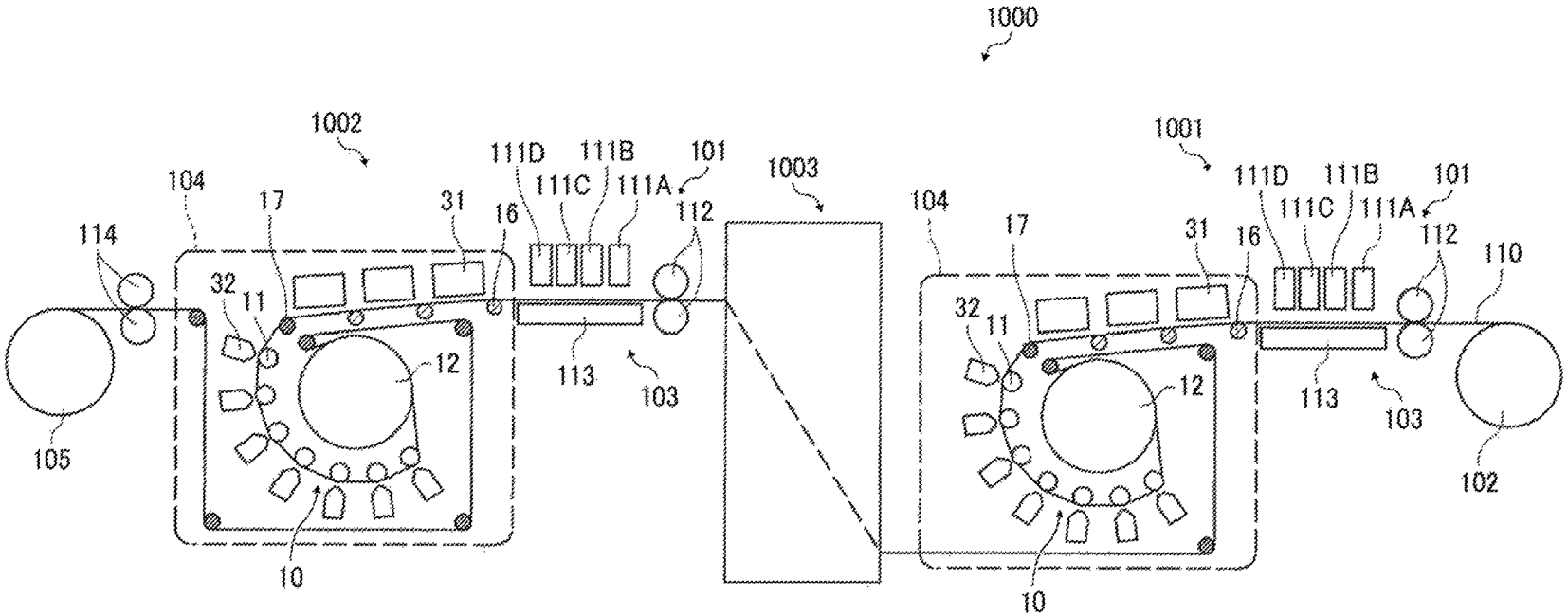
FIG. 13 is a schematic view of the printing apparatus according to a fifth embodiment of the present disclosure.

Next, the printing apparatus according to a fifth embodiment of the present disclosure is described with reference to FIG. 13. FIG. 13 is a schematic view of the printing apparatus according to the fifth embodiment.

In the printing apparatus 1000, a first printing unit 1001 that performs printing and drying with respect to one surface of the continuous sheet 110, a reversing unit 1003 that reverses both surfaces of the continuous sheet 110 of which one surface is printed by the first printing unit 1001, and a second printing unit 1002 that performs printing and drying with respect to the other surface of the continuous sheet 110 are disposed between the feeding roller 102 and the winding roller 105.

In FIG. 13, the configurations of the liquid application unit 101, the conveyance unit 103, and the drying device 104 of each of the first printing unit 1001 and the second printing unit 1002 are approximately the same as (may be the same as) the configurations in the first embodiment, but may be identical or approximately identical to the configurations in any of the second to fourth embodiments.

Here, the liquid application unit 101 of the first printing unit 1001 is a first liquid applicator to apply liquid onto a first surface of the continuous sheet 110, which is the medium to be conveyed. The liquid application unit 101 of the second printing unit 1002 is a second liquid applicator to apply the liquid onto a second surface of the continuous sheet 110, which is the medium to be conveyed, on a side opposite to the first surface.

The drying device 104 of the first printing unit 1001 is a first drying device in which the second surface of the continuous sheet 110 contacts the heating roller 11. The drying device 104 of the second printing unit 1002 is a second drying device in which the first surface of the continuous sheet 110 contacts the heating roller 11.

In each of the above-described embodiments, the term "medium" represents a medium or member to be conveyed by the drying device. In the above descriptions, an example has been described in which the medium to be conveyed is a continuous sheet. However, the medium to be conveyed is not limited to the continuous sheet. For example, a printed object, such as wallpaper or an electronic circuit board sheet (e.g., prepreg), may be used in addition to a continuous material, such as a continuous sheet, a roll sheet and a web, and a recording medium (a printed object) such as an elongated sheet material.

The printing apparatus may form a meaningless image, such as a pattern, with liquid (e.g., ink) for decoration or the like, as well as an image, such as characters or figures recorded on the medium to be conveyed with liquid (e.g., ink).

Herein, the liquid to be applied to the medium to be conveyed is not particularly limited, but it is preferable that the liquid has a viscosity of equal to or less than 30 mPa·s under a normal temperature and a normal pressure or by being heated or cooled. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution three-dimensional fabrication.

When a liquid discharge head is used as the liquid applicator, examples of an energy generation source to discharge a liquid include an energy generation source using a piezoelectric actuator (a lamination piezoelectric element and a thin-film piezoelectric element), a thermal actuator using an electrothermal transducer element such as a heating resistor (element), a static actuator including a diaphragm plate and opposed electrodes, and the like.

Herein, the printing has the same meaning as the meaning of image formation, recording, printing, imprinting, and the like.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A drying device, comprising:

a heater to heat a medium;

a supporter disposed opposite the medium from the heater to support the medium;

a controller to turn on the heater while the medium is conveyed and to turn off the heater when the medium is stopped; and a temperature detector to detect a temperature of the supporter, wherein the controller is connected to the temperature detector to turn off the heater when the temperature detected with the temperature detector is a predetermined temperature or higher.

2. The drying device according to claim 1, wherein the supporter is a roller.

3. The drying device according to claim 2, wherein the roller is a hollow roller, and wherein the temperature detector is disposed inside the hollow roller.

4. The drying device according to claim 3, wherein the temperature detector detects a temperature of an inner surface of the hollow roller facing the heater.

5. The drying device according to claim 1, wherein the heater is an infrared heater, and wherein the temperature detector is disposed on an opposite side of the supporter from the infrared heater.

6. The drying device according to claim 1, further comprising a contact heating member disposed downstream from the heater in a direction of conveyance of the medium, to contact and heat the medium, wherein each of the supporter and the temperature detector is disposed at a position higher than the contact heating member, and wherein a detecting portion of the temperature detector is directed to a side opposite a side at which the contact heating member is disposed.

7. The drying device according to claim 1, further comprising a plurality of contact heating members disposed downstream from the heater in a direction of conveyance of the medium, to contact and heat the medium, wherein a conveyance path of the medium includes:

a first conveyance path on which the medium is conveyed while contacting at least one contact heating member of the plurality of contact heating members; and a second conveyance path on which the medium is conveyed while contacting the at least one contact heating member again.

8. The drying device according to claim 1, further comprising a plurality of contact heating members disposed downstream from the heater in a direction of conveyance of the medium, to contact and heat the medium, wherein the plurality of contact heating members includes:

a first contact heating member having a curved contact face to contact the medium; and a second contact heating member disposed downstream from the first contact heating member in the direction of conveyance of the medium, the second contact heating member having a curved contact face to contact the medium, wherein a contact distance at which the contact face of the second contact heating member contacts the medium is longer than a contact distance at which the contact face of the first contact heating member contacts the medium.

9. A printing apparatus comprising:

a liquid applicator to apply liquid onto the medium; and the drying device according to claim 1, to dry the medium applied with the liquid.

10. The drying device of claim 1, wherein the supporter does not include a heater to heat the medium.

11. A drying device, comprising:

a heater to heat a medium;

a supporter disposed opposite the medium from the heater to support the medium;

a controller to turn on the heater while the medium is conveyed and to turn off the heater when the medium is stopped; and a cut-off switch connected to the controller to cut off power supply to the heater when a temperature of the supporter is a predetermined temperature or higher.

12. A printing apparatus comprising:

a liquid applicator to apply liquid onto the medium; and the drying device according to claim 11, to dry the medium applied with the liquid.

* * * * *